United States Patent [19]

Merry

[11] Patent Number: 4,597,529

[45] Date of Patent: Jul. 1, 1986

[54] SELF-REGULATING SPRAY METHODS AND APPARATUS

[75] Inventor: Jean-Louis Merry, Verneuil en Halatte, France

[73] Assignee: Charbonnages de France, Paris, France

[21] Appl. No.: 628,851

[22] Filed: Jul. 9, 1984

[30] Foreign Application Priority Data

Jul. 8, 1983 [FR] France ..... 83 11425

[51] Int. Cl.[4] ..... B05B 7/06

[52] U.S. Cl. ..... 239/430; 239/405; 239/453

[58] Field of Search ..... 239/1, 107, 108, 404, 239/405, 430, 433, 453, 459, 113, 451

[56] References Cited

U.S. PATENT DOCUMENTS

| | | | |
|---|---|---|---|
| 453,918 | 6/1891 | Ruff | 239/108 |
| 2,229,467 | 1/1941 | Maxwell | 239/459 X |
| 2,414,442 | 1/1947 | Breault | 239/433 X |
| 2,453,416 | 11/1948 | Dom | 239/459 |
| 2,479,166 | 8/1949 | Jenkins, Jr. | 239/113 |
| 2,914,257 | 11/1959 | Wiant | 239/459 X |
| 3,326,470 | 6/1967 | Loudin et al. | 239/404 |
| 3,615,053 | 10/1971 | Pease et al. | 239/433 X |
| 3,742,701 | 7/1973 | Feemster et al. | 239/459 X |
| 3,746,262 | 7/1973 | Bete et al. | 239/459 X |
| 4,341,351 | 7/1982 | De Luca | 239/453 |
| 4,352,462 | 10/1982 | Watanabe et al. | 239/453 X |

FOREIGN PATENT DOCUMENTS

| | | | |
|---|---|---|---|
| 1078545 | 12/1953 | Fed. Rep. of Germany . | |
| 2753788 | 6/1978 | Fed. Rep. of Germany . | |
| 3106962 | 9/1982 | Fed. Rep. of Germany | 239/433 |
| 177223 | 3/1922 | United Kingdom | 239/404 |
| 322257 | 12/1929 | United Kingdom . | |

OTHER PUBLICATIONS

Marine Engineering and Shipbuilding Abstracts, vol. 26, No. 7, Jul. 1963, p. 118, "Spray Nozzle".

*Primary Examiner*—Joseph F. Peters, Jr.
*Assistant Examiner*—David P. Davidson
*Attorney, Agent, or Firm*—Finnegan, Henderson, Farabow, Garrett & Dunner

[57] ABSTRACT

A self-regulating spray nozzle is provided which includes a chamber for receiving both product to be sprayed and a driving fluid. A moveable component is provided for selectively varying the cross-sectional area of an opening provided in an output passage from the chamber in response to pressure developed within the interior of the chamber. A mechanical counter-force is exerted on the moveable component to tend to close the output passage opening of the chamber against the force of the pressure developed in the chamber, and which at least partially overcomes the force of the pressure developed within the interior of the chamber to thereby maintain the pressure drop through the output passage opening substantially constant.

14 Claims, 3 Drawing Figures

SELF-REGULATING SPRAY METHODS AND APPARATUScl BACKGROUND OF THE INVENTION

I. Field of the Invention

The present invention relates to a process for spraying a liquid or paste product and an implementing spray nozzle assembly.

II. Description of the Prior Art

Combustion is often required of mixed heating fuels, such as a slurry of coal and fuel oil. Combustion of such a mixed heating fuel requires a burner having a nozzle which is capable of delivering the proper amount of fuel under a variety of operating conditions. For example, it is preferable that a reduction or increase in the pressure of fuel available to pass through the nozzle and thereafter be burned does not alter the pressure of the fuel which actually passes through the nozzle. Furthermore, it is preferable that the nozzle have the capacity to overcome instances in which particles may become lodged within the nozzle and thereby adversely affect operation.

Accordingly, it is an object of the present invention to provide a process and apparatus for efficiently and effectively spraying a liquid or paste product such as a liquid or paste fuel for use in a powdered coal burner.

More specifically, it is an object of the present invention to provide a method and an apparatus for spraying a liquid or paste product in a manner which maintains desirable spray characteristics even when the pressure of the product available to be sprayed is altered and even when an obstruction occurs within the nozzle.

Additional objects and advantages of the invention will be set forth in part in the description which follows, and in part will be obvious from the description or may be learned by practice of the invention.

SUMMARY OF THE INVENTION

To achieve the foregoing objects, and in accordance with the purposes of the invention as embodied and broadly described herein, a self-regulated spraying nozzle is provided which comprises a chamber having input means for receipt of a product to be sprayed and for receipt of a driving fluid, and further having an output opening for exit of the product and fluid; a moveable component for selectively varying the cross-sectional area of the output opening in response to pressure developed in the interior of the chamber; and mechanical means for exerting a counter-force on the moveable component to at least partially overcome the force exerted by the pressure developed in the interior of the chamber to thereby maintain the pressure drop through the output opening substantially constant.

More specifically, the subject invention comprises a nozzle operable with the aid of a driving force to spray product flowing through a delivery pipe, the nozzle comprising an open-ended body defining an input for the driving fluid and with the distal end of the delivery pipe being located within the body; a cover closing an open end of the body, the cover having an output opening therein; a deflector positioned adjacent the cover to form a chamber between the deflector and the cover; means for forming at least one passageway for the driving fluid from the interior of the body to the interior of the chamber; a moveable component having a conical part extending through the output opening of the cover and having a cylindrical part extending through the deflector into the interior of the body, the conical part having side walls which cooperate with the cover to adjustably vary the cross-sectional area of the output opening in the cover, the side walls further being oriented to increase the cross-sectional area of the output opening as the pressure developed within the chamber increases; and the cylindrical part being hollow to receive product to be sprayed from the distal end of the delivery pipe and having a plurality of orifices communicating with the interior of the chamber; and a spring coupled between the deflector and the moveable component to bias the moveable component in a direction which tends to decrease the cross-sectional area of the output opening in the cover, the spring being of sufficient strength to at least partially overcome the force of the pressure developed within the chamber thereby tending to maintain the pressure drop through the output opening substantially constant.

Still another form of the invention involves a process for spraying a liquid or pasty product from a nozzle incorporating a variable cross-section output opening, the process comprising the steps of: delivering a product to be sprayed to the nozzle; delivering a driving fluid to the nozzle which, together with the product to be sprayed, tends to increase the cross-sectional area of the output opening; and developing a mechanical counterpressure which tends to decrease the cross-sectional area of the output opening and thereby maintain a substantially constant pressure drop through the output opening of the nozzle.

DESCRIPTION OF THE PREFERRED EMBODIMENT

Reference will now be made in detail to the present preferred embodiment of the subject invention as illustrated in the accompanying drawings.

Figure 1:
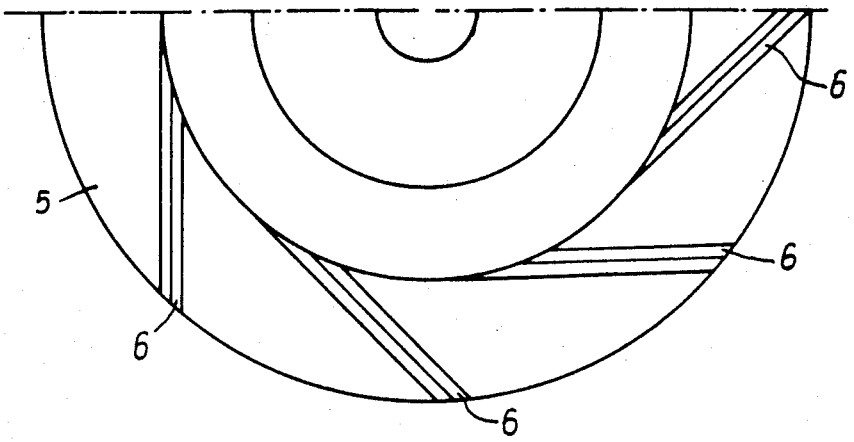
FIG. 1 is a sectional diagram of a spray nozzle incorporating the teachings of the subject invention.

As illustrated in FIG. 1, a preferred embodiment of the subject invention comprises an open-ended body 1 having an internal annular space 2 into which there may be delivered a driving fluid such as steam, compressed air or combustible gas. Within the interior of body 1 there is located the distal end of a delivery pipe 3 through which the product to be sprayed may be delivered to the interior of body 1. Product to be sprayed may be a liquid or pasty product such as that used in connection with the burning of powdered coal.

An open component or cover 4 closes the illustrated lower open end of body 1. Cover 4 preferably comprises a hard material which withstands abrasion and cannot be pierced, such as a ceramic or tungsten carbide. Cover 4 has an annular output slot or opening 18 which will be discussed in more detail below.

Figure 2:
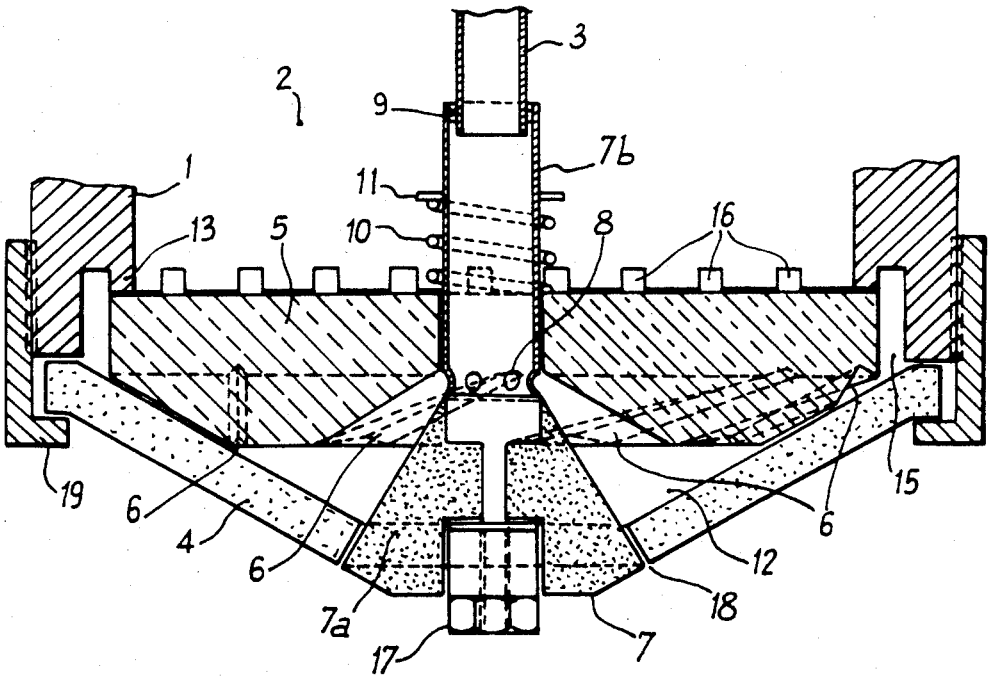
FIG. 2 is a top view showing one-half of a deflector used in connection with the embodiment of the nozzle disclosed in FIG. 1.

As is further shown in FIGS. 1 and 2, there is provided a deflector 5 which may be clamped between cover 4 and body 1. Deflector 5 is positioned within body 1 to form a chamber 12 between deflector 5 and cover 4. Moreover, the combination of deflector 5 and body 1 includes a mechanism for forming a passageway for allowing driving fluid to pass from annular space 2 into chamber 12. Specifically, deflector 5 is clamped between cover 4 and body 1 in such a way that it is possible for driving fluid to pass between the periphery of deflector 5 and an interior wall of body 1. This passage may be obtained, for example, by means of spacers of suitable shapes or by openings provided between body 1 and the periphery of deflector 5. As illustrated in FIG. 1, openings, consisting of notches 16, are made on a circular rim 13 of body 1. In the alternative, these notches may be made in a circular rim carried by deflector 5. In either case, notches 16 lead to circular channel 15 around the periphery of deflector 5.

The aforementioned passage further includes grooves 6 located on a face of deflector 5 which is in contact with a surface of cover 4. As is shown primarily in connection with FIG. 2, grooves 6 are preferably tangential to a circle which is concentric with the periphery of circularly-shaped deflector 5. This particular arrangement makes it possible to produce rotation of the product to be sprayed within the confines of annular chamber 12. The cross-section of grooves 6 may be of any shape and need not be the same from end to end. Preferably, this cross-section is triangular in form. It is also preferable that the number of grooves be between four and eight and that the grooves be uniformly distributed. It is still further preferable that the underside of deflector 5 have on the surface facing cover 4 a centrally located conical recess section into which grooves 6 deliver driving fluid from annular space 2.

Cover 4 preferably is fixed at its periphery to body 1 by any known means such as by welding or bolting. This fixing may also be achieved by means of a clamping ring 19. Cover 4 may be of any shape, for example, cylindrical or spherical. Preferably, cover 4 is frustoconical as shown in FIG. 1. The face of deflector 5 which is directed against cover 4 preferably has the same shape as cover 4, thus providing a constant surface, with the only discontinuities between defelector 5 and cover 4 arising from the presence of grooves 6.

In accordance with the present invention, a moveable component is provided for selectively varying the cross-sectional area of an output opening in the nozzle cover in response to pressure developed within the interior of the chamber formed between the cover and deflector. Specifically, there is preferably provided a moveable component 7 having a conical part *7a* extending through output opening 18 of cover 4 and having a cylindrical part *7b* extending through deflector 5 into the interior of body 1. Conical part *7a* has side walls which cooperate with cover 4 to adjustably vary the cross-sectional area of annular opening 18 created between conical part *7a* and the walls of cover 4 which define the outer periphery of opening 18. Annular opening 18 is adjustable as a function of the longitudinal orientation of conical part *7a*. The side walls of conical part *7a* are oriented within chamber 12 to bias movable component 7 toward a longitudinal orientation which tends to increase the cross-sectional area of opening 18 as the pressure developed within chamber 12 increases.

Cylindrical part *7b* of moveable component 7 is hollow and is connected to delivery pipe 3 to receive product to be sprayed from the distal end of delivery pipe 3. Cylindrical part *7b* has a plurality of orifices 8 positioned to expose the interior of cylindrical part *7b* to the interior of chamber 12. A sealing device 9 is located between delivery pipe 3 and cylindrical part *7b*. A nut 17 may be used to hold conical part *7a* and cylindrical part *7b* together.

As a consequence of the foregoing, annular chamber 12 is formed between cover 4, deflector 5, and conical part *7b* of moveable component 7.

The axis of opening 18 in cover 4 and the axis of conical part *7a* of component 7 are preferably coincident. The axis of the opening in deflector 5 through which cylindrical part *7b* passes and the axis of cylindrical part *7b* of component 7 are also preferably coincident. It is still further preferable that all four of these axes be coincident and that these four axes be coincident with the axis of body 1 and the axis of delivery pipe 3.

As may be appreciated, as product to be sprayed flows through delivery pipe 3, cylindrical section *7b*, and orifices 8 into chamber 12, and as driving fluid from space 2 flows through notches 16 of rim 13, circular channel 15, and grooves 6 into chamber 12, a pressure is developed within chamber 12 which acts against the walls of conical section *7a* to force moveable component 7 away from opening 18 of cover 4, thereby developing an increased area for annular opening 18.

In accordance with the present invention, mechanical means are provided for exerting a counter-force on the moveable component of the subject nozzle to tend to at least partially overcome the force exerted by the pressure developed in the interior of a chamber of the nozzle and thereby maintain the pressure drop through the output opening of the nozzle substantially constant.

As shown in FIG. 1 by way of illustration and not limitation, there is provided a return spring 10 situated between deflector 5 and a bearing support 11 on cylindrical part *7b* of moveable component 7. Bearing support 11 may consist of a stop ring or a shoulder on cylindrical part *7b*. The pressure drop through output opening 18 (which is equal to the difference between the pressure within chamber 12 and atmospheric pressure outside the nozzle) is kept substantially constant by partially compensating the pressure developed within chamber 12 by the driving fluid from space 2 with the mechanical counter-force developed by spring 10.

The mechanical counter-force developed by spring 10 operates to tend to pull moveable component 7 back into opening 18 of cover 4 thereby reducing the cross-sectional area of opening 18. Accordingly, upon passage of product to be sprayed through delivery pipe 3 and orifices 8, and upon the passage of driving fluid through grooves 6, an equilibrium condition is developed in which conical portion *7a* of moveable component 7 extends a given distance beyond cover 4 against the counterbiasing force of spring 10 to keep annular opening 18 at a certain cross-sectional area. Once this equilibrium position is developed, the pressure drop through opening 18 is kept substantially constant even if the flow of product to be sprayed is deliberately reduced. In such an instance, the cross-sectional area of opening 18 is automatically reduced through operation of spring 10 until the pressure within chamber 12 again reaches the amount formerly obtained upon equilibrium. Moreover, if an obstruction in opening 18 should occur, a build up in pressure within chamber 12 results, forcing conical portion *7a* into a further outward position by widening opening 18, thereby permitting the obstruction to be dislodged. Upon dislodging, the cross-sectional area of opening 18 is automatically returned to its normal value, thereby maintaining a constant pressure drop through opening 18.

The mechanical counter-force as noted above may be produced by spring 10. As can be readily understood, spring 10 and thus the return force may be chosen to achieve the required pressure drop.

It should be understood that the amount by which annular slot 18 is opened is a function of the combined pressure of the product to be sprayed and the driving fluid in chamber 12, the shape of conical part *7a*, the shape of the resultant slot or opening 18 and the particular force exerted by spring 10. The force exerted by spring 10 is technically a function of the displacement distance of spring 10. However, although all these factors are involved, the pressure drop developed within chamber 12 is primarily a function of the force exerted by spring 10. Accordingly, the particular shape of conical section *7a* and opening 18, although influential, is not considered to be an essential aspect of the subject invention. Moreover, it should be understood that mathematically speaking the pressure drop is not maintained exactly constant due to the fact that as a variation in spring length occurs a variation in its tension also technically occurs. Since the pressure drop is essentially a function of spring tension, the pressure drop is not, therefore, exactly mathematically maintained constant. However, in practice, the pressure drop will be substantially constant.

Figure 3:
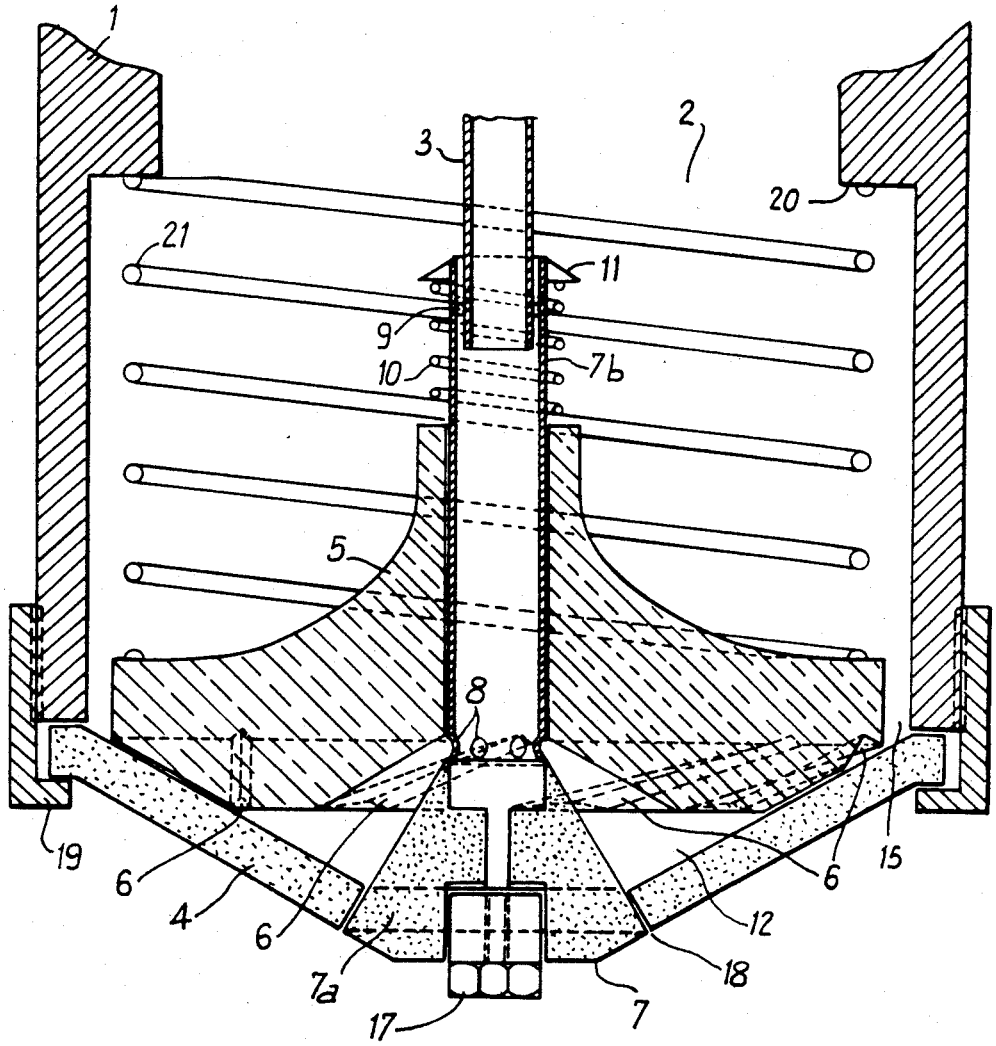
FIG. 3 is a sectional view of another embodiment of a spray nozzle incorporating the teachings of the subject invention.

FIG. 3 shows an alternative form of the interior wall of body 1. Specifically, in FIG. 3 there is illustrated a shoulder 20 within body 1. There is further shown a retaining spring 21 placed between this shoulder and deflector 5. The conical part of deflector 5 is thereby pressed by spring 21 against the inner frustoconical surface of cover 4. In the embodiment of FIG. 3, an auxiliary driving fluid located within annular space 2 of body 1 passes between the spiral turns of spring 21 into circular channel 15 and from circular channel 15 through grooves 6 into the interior of chamber 12.

In summary, the product to be sprayed enters delivery pipe 3 with the aid of a pump and arrives inside cylindrical part *7b* of moveable component 7. The product to be sprayed comes out through orifices 8 and flows along conical part *7a* of moveable component 7 or along the visible part of the frustoconical interior face of cover 4, depending upon the position of the nozzle relative to the vertical.

Driving fluid, for example, compressed air, is conveyed under pressure to annular space 2 formed between the interior walls of body 1 and delivery pipe 3. From there, the driving fluid enters circular channel 15 by way of notches 16 and is then distributed into tangential grooves 6 to reach annular chamber 12. Upon reaching annular chamber 12, the driving fluid causes the product to be sprayed, present therein, to rotate.

A mixture of the product to be sprayed and the driving fluid formed in annular chamber 12 escapes by way of annular slot or opening 18 which is formed between the edge of a central opening in cover 4 and the walls of conical part *7a*. The width of slot or opening 18 varies as a function of the pressure predominating in annular chamber 12 and of the counter-force generated by return spring 10. A pressure drop is established through opening 18 which is equal to the difference between the pressure within chamber 12 and atmospheric pressure. This pressure drop is kept substantially constant by means of return spring 10.

A spraying nozzle according to the subject invention makes it possible to maintain the pressure drop in circular slot 18 substantially constant even if the flow of product to be sprayed is deliberately reduced. This maintenance of constant pressure drop thus assures good spraying. Moreover, the subject invention maintains a constant pressure drop even if an obstruction of slot 18 occurs. In this case, the pressure drop momentarily rises and the width of the slot increases, thereby permitting contaminants obstructing slot 18 to be discharged. After this discharge, the chosen value of the pressure drop is automatically reestablished.

The nozzle according to the present invention, therefore, makes it possible to spray a liquid of nearly any viscosity, by regulating the pressure drop by means of return spring 10. Accordingly, the subject nozzle makes it possible to effectively and efficiently spray pasty products.

Finally, it should be noted that the spray of the subject nozzle forms a homogeneous hollow sheet, and not just juxtapositioned jets.

Additional advantages and modifications will readily occur to those skilled in the art. The invention, in its broader aspects, is not limited to the specific details, representative methods and illustrative examples shown and described. Accordingly, departures may be made from such details without parting from the spirit or scope of applicant's general inventive concept.

I claim:

1. A self-regulating nozzle comprising:

(a) a chamber having input means for delivery into said chamber of a product to be sprayed along a plurality of first directions and further having an output opening for exit of said product;

(b) a moveable component for selectively varying the cross-sectional area of said output opening in response to pressure developed in the interior of said chamber, said moveable component having a hollow body for receipt of a driving fluid and having at least one orifice for delivery of said driving fluid into said chamber along a plurality of second directions which intersect said first direction to facilitate mixing of said product and said driving fluid; and (c) mechanical means for exerting a counter-force on said moveable component to at least partially overcome the force exerted by said pressure developed in the interior of said chamber to therby maintain the pressure drop through said output opening substantially constant.

2. The nozzle of claim 1 wherein said mechanical means comprises a spring.

3. The nozzle of claim 1 wherein said moveable component includes conical side walls, at least a portion of which are located within said output opening and at least a portion of which are exposed to the interior of said chamber, whereby the force of said pressure developed in the interior of said chamber tends to move said moveable component in a direction outward of said output opening.

4. The nozzle of claim 3 wherein said moveable component further comprises a cylindrical section and said mechanical means for exerting a counter-force on said moveable component comprises a spring coupled to said cylindrical section.

5. A self-regulating nozzle operable with the aid of a driving fluid to spray product flowing through a delivery pipe, said nozzle comprising:

(a) an open-ended body defining an input for said driving fluid, with the distal end of said delivery pipe being located within said body;

(b) a cover closing an open end of said body, said cover having an output opening therein;

(c) a deflector positioned adjacent said cover to form a chamber between said deflector and said cover;

(d) means for forming at least one passageway for said driving fluid from the interior of said body to said chamber;

(e) a movable component having a conical part extending through said output opening of said cover and having a cylindrical part extending through said deflector into the interior of said body, said conical part having side walls which cooperate with said cover to adjustably vary the cross-sectional area of said output opening in said cover, said side walls further being oriented to increase the cross-sectional area of said output opening as the pressure developed within said chamber increases, and said cylindircal part being hollow to receive product to be sprayed from said distal end of said delivery pipe and having a plurality of orifices communicating with the interior of said chamber; and (f) a spring coupled between said deflector and said movable component to bias said moveable component in a direction which tends to decrease the cross-sectional area of said output opening in said cover, said spring being of sufficient strength to at least partially overcome the force generated by the pressure developed within said chamber, thereby tending to maintain the pressure drop through said output opening substantially constant.

6. A nozzle of claim 5 wherein said passageway means includes an annular channel located around the periphery of said deflector and a plurality of grooves within said deflector extending from said annular channel to said chamber.

7. A nozzle of claim 6 wherein said deflector is circular in cross-section and said grooves are tangential to a circle which is concentric with the periphery of said deflector.

8. A nozzle according to claim 6 wherein said passageway means includes a plurality of openings which are provided between said body and said deflector and which are formed by notches made in a rim of said body.

9. A nozzle according to claim 6 wherein said passageway means includes a plurality of openings which are provided between said body and said deflector and which are formed by notches made in a circular rim varied by said deflector.

10. A nozzle according to claim 6 wherein said body includes a shoulder, and said nozzle further includes a second spring, said deflector being held in place by means of said second spring, one end of which rests on said deflector and the other end of which rests on said shoulder of said body.

11. A nozzle according to claim 6 wherein said moveable component comprises a hard material which withstands abrasion and cannot be pierced.

12. A nozzle according to claim 11 wherein said material is selected from a group comprising ceramics and tungsten carbide.

13. A nozzle according to claim 6 wherein said cover comprises a hard material which withstands abrasion and cannot be pierced.

14. A nozzle of claim 13 wherein said material is selected from the group comprising ceramics and tungsten carbide.

* * * * *